US005954425A

United States Patent [19]

Lin

[11] Patent Number: 5,954,425

[45] Date of Patent: Sep. 21, 1999

[54] WATERPROOF LAMP SOCKET

[76] Inventor: Mei-Lu Lin, 56, Min Sheng Street, Fengyuan, Taichung Hsien, Taiwan, 420

[21] Appl. No.: 08/946,752

[22] Filed: Oct. 11, 1997

[51] Int. Cl.[6] ..... F21V 29/00

[52] U.S. Cl. ..... 362/391; 362/249; 362/294; 439/419; 439/206

[58] Field of Search ..... 362/249, 294, 362/391; 439/419, 414, 602, 206

[56] References Cited

U.S. PATENT DOCUMENTS

| | | | |
|---|---|---|---|
| 5,051,877 | 9/1991 | Liou | 362/249 |
| 5,446,640 | 8/1995 | Lin | 362/407 |
| 5,605,395 | 2/1997 | Peng | 362/226 |
| 5,626,415 | 5/1997 | Hwang | 362/226 |
| 5,626,419 | 5/1997 | Lin | 362/391 |
| 5,709,457 | 1/1998 | Hara | 362/96 |
| 5,722,771 | 3/1998 | Wang | 362/294 |
| 5,738,435 | 4/1998 | Lin et al. | 362/249 |
| 5,752,765 | 5/1998 | Liou | 362/226 |

*Primary Examiner*—Laura K. Tso

[57] ABSTRACT

A waterproof lamp socket has a main body, a base seat engaging with the main body, and two-ply wires disposed between the main body and the base seat. The main body has a bottom in which includes, a first slot receiving a first tip contact plate, a second slot receiving a second tip contact plate, two insertion holes, a plurality of rim notches, and a plurality of inner peripheral channels extending from the notches to the bottom. The base seat has two grooves for receiving the wires and two positioning plates inserted in the rectangular holes and each has a hook end. So that the external water entered into the socket will be drained off via the peripheral channels without permeating the tip contact plates which are protected by the positioning lates.

2 Claims, 3 Drawing Sheets

WATERPROOF LAMP SOCKET

BACKGROUND OF THE INVENTION

This invention relates to a lamp socket, and more particularly to a waterproof lamp socket which is adapted to receive a decoration bulb on a Christmas tree.

A conventional lamp socket has a waterproof cushion to protect a decoration bulb. Another conventional lamp socket has a water drainage structure. However, the conventional water drainage structure cannot drain water efficiently. Thus the remained water may cause electric leakage or poor conductivity.

SUMMARY OF THE INVENTION

A main object of this invention is to provide a waterproof lamp socket which can drain water from the waterproof lamp socket efficiently.

DETAILED DESCRIPTION OF THE PREFERRED EMBODIMENT

Figure 1:
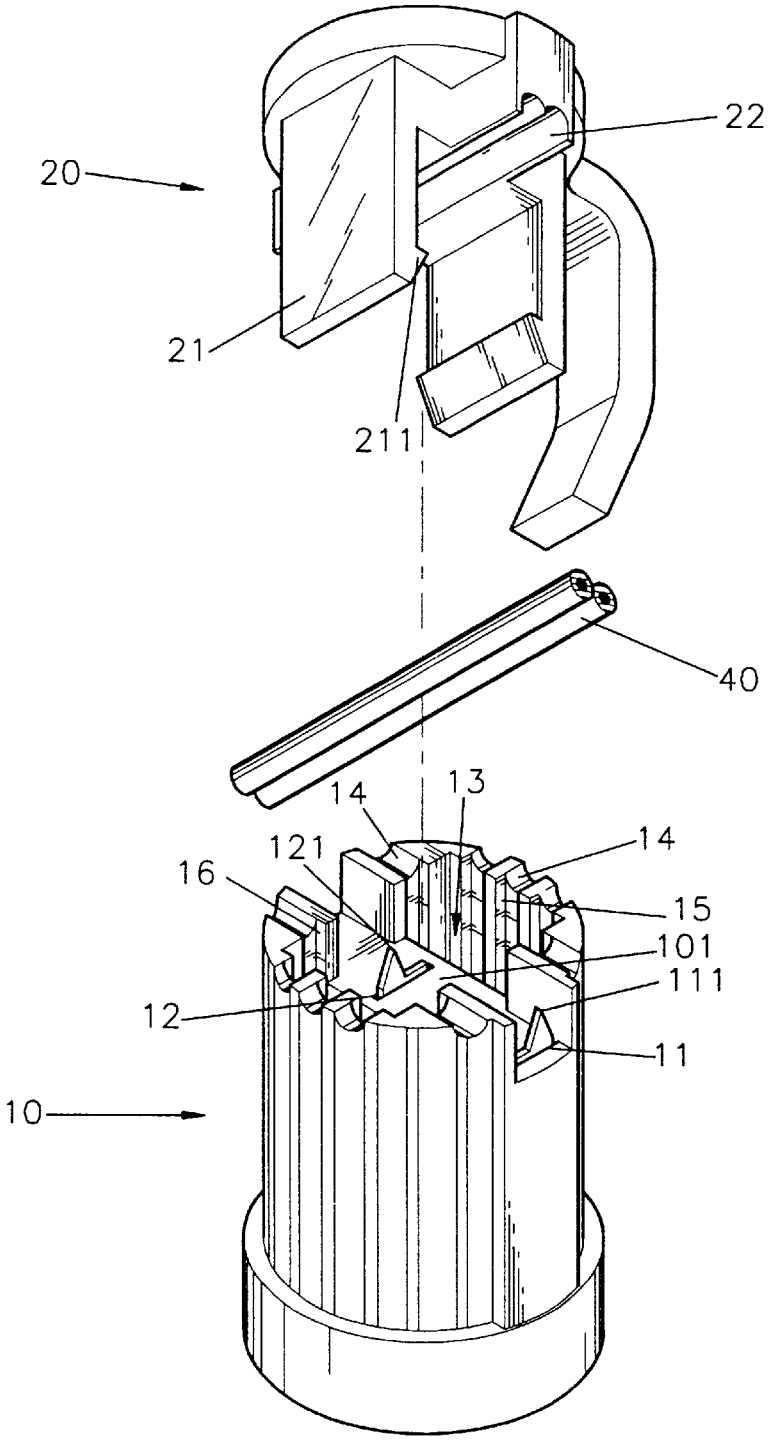
FIG. 1 is a perspective exploded view of a preferred embodiment of the present invention.

Referring to FIGS. 1 to 4, a decoration lamp socket comprises a main body 10, a base seat 20 engaging with the main body 10, and two-ply wires 40 disposed between the main body 10 and the base seat 20.

The main body 10 has a bottom 101, a first slot 11 receiving a first tip contact plate 111, a second slot 12 receiving a second tip contact plate 121, a pair of rectangular holes 13 abutting the symmetrical circumferences of the bottom 101 perpendicular to the slots 11 and 12, a plurality of rim notches 14, and a plurality of inner periphery channels 15, 16.

The base seat 20 has two grooves 22 parallel and radially extending through the inner surface for receiving the wires 40 and two positioning plates 21 parallel and symmetrically projected upward and insertable in the rectangular holes 13 of the bottom 101. Each of the positioning plates 21 has a hook end 211 facing each other.

Figure 3:
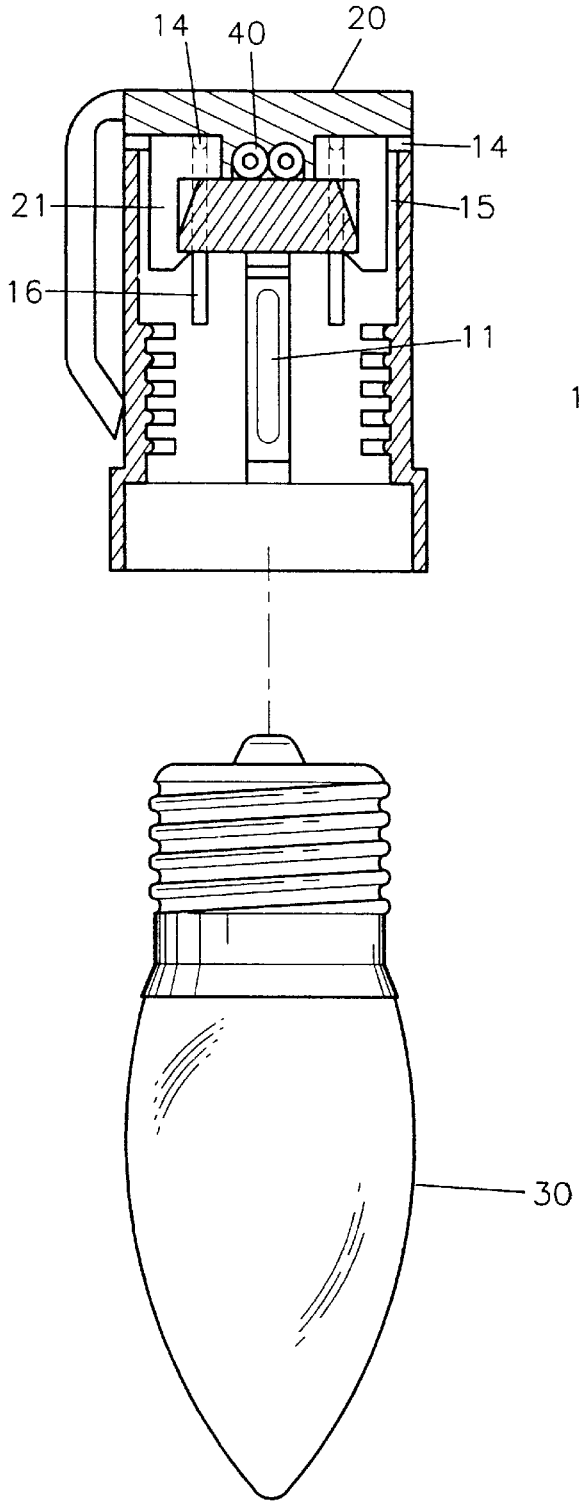
FIG. 3 is a sectional view of the waterproof lamp socket and a perspective view of a decoration bulb engaging with the socket.
Figure 2:
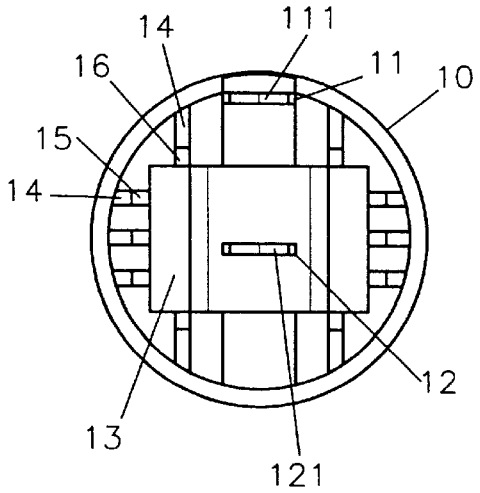
FIG. 2 is a bottom plan view of a main body of the preferred embodiment.
Figure 4:
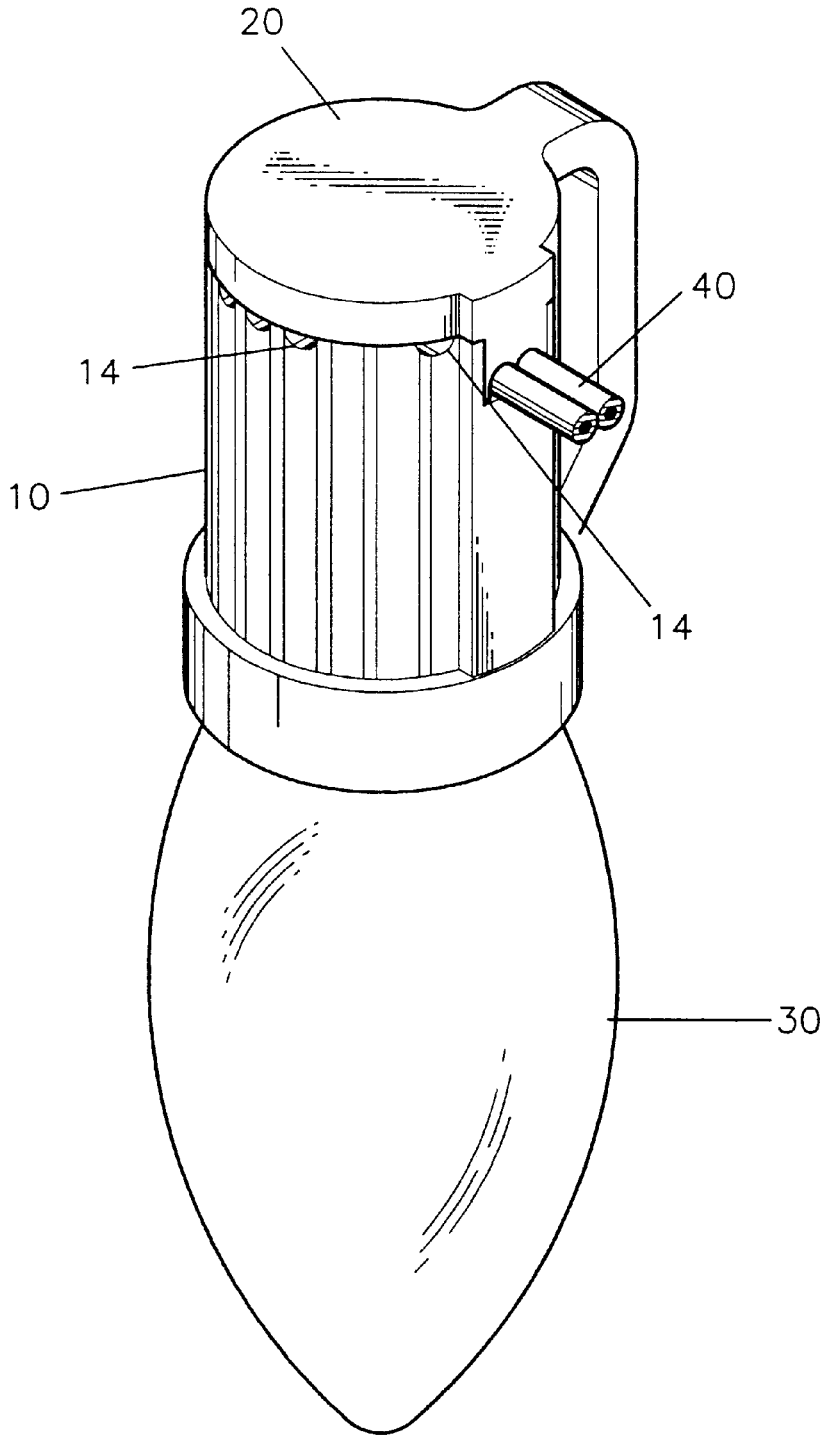
FIG. 4 is a perspective view to show the assemblage of the present invention.

A decoration bulb 30 is engaged into the main body 10 (as shown in FIGS. 3 and 4).

Referring to FIGS. 2 and 3 again, when the base seat 20 is snapped up to the main body 10, the positioning plates 21 protect the first tip contact plate 111 and the second tip contact plate 121 against any external water which may enter into the tip contact plate 111 and 121 of the lamp socket via the rim notches 14. However, if the water or rain enters the lamp socket, the rim notches 14 and the inner peripheral channels 15, 16 can drain water quickly and efficiently out of the socket.

This invention has the following advantages.

The base seat 20 does not have any engaging hole the external water cannot enter into the lamp socket via the base seat 20.

The rim notches 14 and the inner peripheral channels 15, 16 can drain water efficiently out of the socket.

I claim:

1. A water-proof lamp socket comprising:

a tubular main body comprising a first end and a second end wherein said first end receives a light bulb;

said second end comprising a rim having notches surrounding a bottom surface and a pair of rectangular holes, said bottom surface comprising a first slot for receiving a first contact plate; a second slot for receiving a second contact plate; said pair of rectangular holes being perpendicular to said first and second slots;

said main body further comprising a plurality of inner peripheral channels vertically extending through said main body from said rim notches; and a base seat configured to engage the main body comprising a surface having a pair of parallel grooves for receiving a two-ply wire positioned between the bottom surface of the tubular main body and said surface of the base seat; and a pair of positioning plates projecting from the mating surface and insertable in the rectangular holes;

whereby said peripheral channels drain water from said bottom surface.

2. The water proof lamp socket as claimed in claim 1 wherein said positioning plates having hooked ends facing each other.

* * * * *